US012768184B2

(12) United States Patent
VanderSlik et al.

(10) Patent No.: US 12,768,184 B2
(45) Date of Patent: Oct. 20, 2026

(54) PRIVATE RESIDENCE WITH CARE ROOM AND CARE FACILITY INCLUDING THE SAME

(71) Applicant: Baptist Retirement Homes of North Carolina, Incorporated, Winston-Salem, NC (US)

(72) Inventors: Reed VanderSlik, Pfafftown, NC (US); Alan L. Moore, Winston-Salem, NC (US); Peter B. Epermanis, Winston-Salem, NC (US)

(73) Assignee: Baptist Retirement Homes of North Carolina, Incorporated, Winston-Salem, NC (US)

( * ) Notice: Subject to any disclaimer, the term of this patent is extended or adjusted under 35 U.S.C. 154(b) by 193 days.

(21) Appl. No.: 18/421,477

(22) Filed: Jan. 24, 2024

(65) Prior Publication Data

US 2025/0215712 A1 Jul. 3, 2025

Related U.S. Application Data

(60) Provisional application No. 63/615,829, filed on Dec. 29, 2023.

(51) Int. Cl.

| | |
|---|---|
| ***E04H 1/02*** | (2006.01) |
| ***E04H 1/00*** | (2006.01) |
| ***E04H 3/08*** | (2006.01) |

(52) U.S. Cl.

CPC ..... *E04H 1/02* (2013.01); *E04H 1/005* (2013.01); *E04H 3/08* (2013.01)

(58) Field of Classification Search

CPC ..... E04H 1/005; E04H 1/02; E04H 3/08

(Continued)

(56) References Cited

U.S. PATENT DOCUMENTS 2,154,897 A * 4/1939 Grant ..... E04B 1/34815 D25/4
2,764,783 A * 10/1956 Teller ..... E04B 1/346 52/65

(Continued)

OTHER PUBLICATIONS

The Greenhouse Project, https://thegreenhouseproject.org/wp-content/uploads/Home_for_Success_web.pdf, known at least as early as Feb. 16, 2024, 3 pgs.

*Primary Examiner* — Brian E Glessner

(74) *Attorney, Agent, or Firm* — Womble Bond Dickinson (US) LLP

(57) ABSTRACT

A care facility includes a connecting ring, a central building, and a plurality of residences. The central building is connected to the connecting ring. The plurality of residences are disposed about the connecting ring with each residence including a shared area, a private area, and an exterior entrance. The shared area includes a care bedroom that is connected to the connecting ring such that the care bedroom is accessible directly from the connecting ring. The private area includes a private bedroom that is connected to the care bedroom and separated from the connecting ring. The care bedroom is accessible directly from the private bedroom through a residence entrance. The residence entrance being securable to prevent access from the care bedroom and the connecting ring. The exterior entrance that provides access to the private bedroom separate from the connecting ring and the central building.

20 Claims, 3 Drawing Sheets

(58) Field of Classification Search
USPC ..... 52/79.4
See application file for complete search history.

(56) References Cited

U.S. PATENT DOCUMENTS 3,267,955 A * 8/1966 Logan ..... E04H 3/08 454/251
3,295,265 A * 1/1967 Naoto ..... E04H 9/16 52/246
3,535,835 A * 10/1970 Kupper ..... E04B 1/34 52/185
3,606,045 A * 9/1971 Abromavage et al. ..... B65G 29/00 198/346.3
3,623,283 A * 11/1971 Abromavage et al. ... E04H 3/08 52/72
3,638,641 A * 2/1972 Abromavage ..... E04H 3/08 600/301
3,696,805 A * 10/1972 Sweeten ..... E04H 3/08 52/234
3,707,812 A * 1/1973 Roessl ..... E04H 1/02 60/407
3,742,932 A * 7/1973 Greenspan ..... A61G 10/00 52/750
3,754,364 A * 8/1973 Ice ..... E04H 1/02 52/299
3,769,766 A * 11/1973 Speidel ..... E04B 1/34846 D25/4
3,789,560 A * 2/1974 Wood ..... E04H 1/005 52/236.1
3,862,525 A * 1/1975 Greenspan ..... A61G 10/00 52/234
5,353,557 A * 10/1994 Lerner ..... E04H 3/08 52/106
6,182,408 B1 * 2/2001 Poehler ..... E04H 1/02 52/234
6,330,771 B1 * 12/2001 Hester, Jr. ..... E04H 3/08 52/234
6,360,494 B1 * 3/2002 Emerson ..... E04H 3/08 52/106
6,360,496 B1 * 3/2002 Raccuglia ..... E04B 7/028 52/63
6,944,996 B1 * 9/2005 Rowe ..... E04H 9/14 52/200
11,193,288 B1 * 12/2021 Istel ..... E04H 3/06
12,173,497 B2 * 12/2024 Beisl ..... E04B 1/348
2002/0046518 A1 * 4/2002 Eguchi ..... E04H 1/005 52/220.1
2005/0252100 A1 * 11/2005 Nord ..... E04H 1/02 52/79.4
2019/0383046 A1 * 12/2019 Frey ..... E04H 3/08

* cited by examiner

PRIVATE RESIDENCE WITH CARE ROOM AND CARE FACILITY INCLUDING THE SAME

CROSS-REFERENCE TO RELATED APPLICATION

This application claims benefit of, and priority to, U.S. Provisional Patent Application Ser. No. 63/615,829, filed Dec. 29, 2023, the entire contents of which are hereby incorporated by reference.

BACKGROUND

1. Technical Field

The present disclosure relates to care facilities, more specifically, to long-term care facilities with private residences sharing a care room with the care facility.

2. Discussion of Related Art

Long-term care facilities provide care for individuals that need round-the-clock or near round-the-clock care. These long-term facilities may have private or shared rooms for patients or residents that open to common areas. These private or shared rooms may be accessible by staff and sometimes other patients or residents from the care facility. Some facilities may allow a spouse or partner that does not need any care or less than round-the-clock care to live with the patient. However, these facilities require the spouse or partner to live in the same rooms or space with the patient.

SUMMARY

This disclosure relates generally to a long-term care facility with a private residence that allows for a spouse or a partner to live in an independent home that includes a shared care room with a long-term care facility. The shared care room may provide a room suitable for a patient of the long-term care facility while the private residence allows for a spouse or a partner of the patient to have a separate residence but allows access to the patient. The shared care room may be optimized for a particular illness of the patient. For example, the shared care room may be optimized for a dementia patient.

In an aspect of the present disclosure, a care facility includes a connecting ring, a central building, and a plurality of residences. The central building is connected to the connecting ring. The plurality of residences are disposed about the connecting ring with each residence including a care bedroom, a private bedroom, and additional rooms. The care bedroom is connected to the connecting ring and is accessible directly from the connecting ring. The private bedroom is connected to the care bedroom and separated from the connecting ring. The care bedroom is accessible directly from the private bedroom through a residence entrance that is securable to prevent access from the care bedroom and the connecting ring. The additional room provides access to the private bedroom separate from the care bedroom. The additional rooms may include a kitchen.

In another aspect of the present disclosure, a care facility includes a connecting ring, a central building, and a plurality of residences. The central building is connected to the connecting ring. The plurality of residences are disposed about the connecting ring with each residence including a shared area, a private area, and an exterior entrance. The shared area includes a care bedroom that is connected to the connecting ring such that the care bedroom is accessible directly from the connecting ring. The private area includes a private bedroom that is connected to the care bedroom and separated from the connecting ring. The care bedroom is accessible directly from the private bedroom through a residence entrance. The residence entrance being securable to prevent access from the care bedroom and the connecting ring. The exterior entrance that provides access to the private bedroom separate from the connecting ring and the central building.

In aspects, the care facility includes a plurality of rooms that are accessible from the exterior entrance or the private bedroom entrance. The plurality of rooms may include a kitchen.

In some aspects, the shared area includes a care bathroom that is accessible from the care bedroom and the private area includes a private bathroom accessible from the private bedroom. The shared area includes a care closet that is accessible from the care bedroom and the private area may include a private closet that is accessible from the private bedroom. The care closet may be sized to hold only a single day worth of clothing.

In certain aspects of the present disclosure, the care facility includes a courtyard. The connecting ring may be disposed about the courtyard such that the courtyard is disposed within a space defined by the connecting ring. The connecting ring may define a substantially circular shape for the courtyard. The courtyard may only be accessible from the central building.

In particular aspects of the present disclosure, the central building defines a main entrance that provides access to the central building, the connecting ring, and the shared areas via the connecting ring. The connecting ring may include a service entrance that provides direct access to the connecting ring. The service entrance may be positioned opposite the central building with respect to the connecting ring.

In aspects, the shared area includes a care entrance between the care bedroom and the connecting ring. The care entrance may be securable from the care bedroom to limit access to the care bedroom from the connecting ring. The care entrance may be securable from the connecting ring to limit access to the connecting ring from the care bedroom. The care bedroom may be configured to care for a memory care patient. The care facility may include twelve residences disposed about the connecting ring.

In another aspect of the present disclosure, a care facility includes common areas and a plurality of residences. Each residence includes a shared area having a care bedroom that is connected to the common areas such that the shared area is accessible from the common areas. Each residence also includes a private area that includes a private bedroom that is connected to the care bedroom and is separated from the common areas by the care bedroom. The care bedroom is accessible directly from the private bedroom through a residence entrance. The residence entrance is securable to prevent access from the care bedroom and the common areas. Each residence also includes an exterior entrance that provides access to the private bedroom that is separate from the common areas.

In aspects, the common areas include a connecting hall. Each care bedroom may be accessible directly from the connecting hall. The common areas may include a central building that provides access to the exterior of the care facility and to the connecting hall.

In another aspect of the present disclosure, a private residence includes a care suite and an exterior entrance. The care suite includes a shared area and a private area. The care suite includes a care bedroom that has a care entrance that is configured to connect to a common area of a care facility to allow access to the care bedroom separate from the rest of the private residence. The private area includes a private bedroom that has a residence entrance defined between the care bedroom and the private bedroom to allow access directly to the care bedroom from the private bedroom. The private bedroom has a bedroom entrance that is separate from the residence entrance. The exterior entrance is connected to the residence entrance to allow access to the private bedroom from an exterior of the private residence without passing through the shared area of the care suite.

In aspects, the private residence includes a plurality of rooms between the exterior entrance and the bedroom entrance.

Further, to the extent consistent, any of the embodiments or aspects described herein may be used in conjunction with any or all of the other embodiments or aspects described herein.

BRIEF DESCRIPTION OF THE DRAWINGS

Various aspects of the present disclosure are described hereinbelow with reference to the drawings, which are not necessarily drawn to scale, which are incorporated in and constitute a part of this specification, wherein.

DETAILED DESCRIPTION

Figure 1:
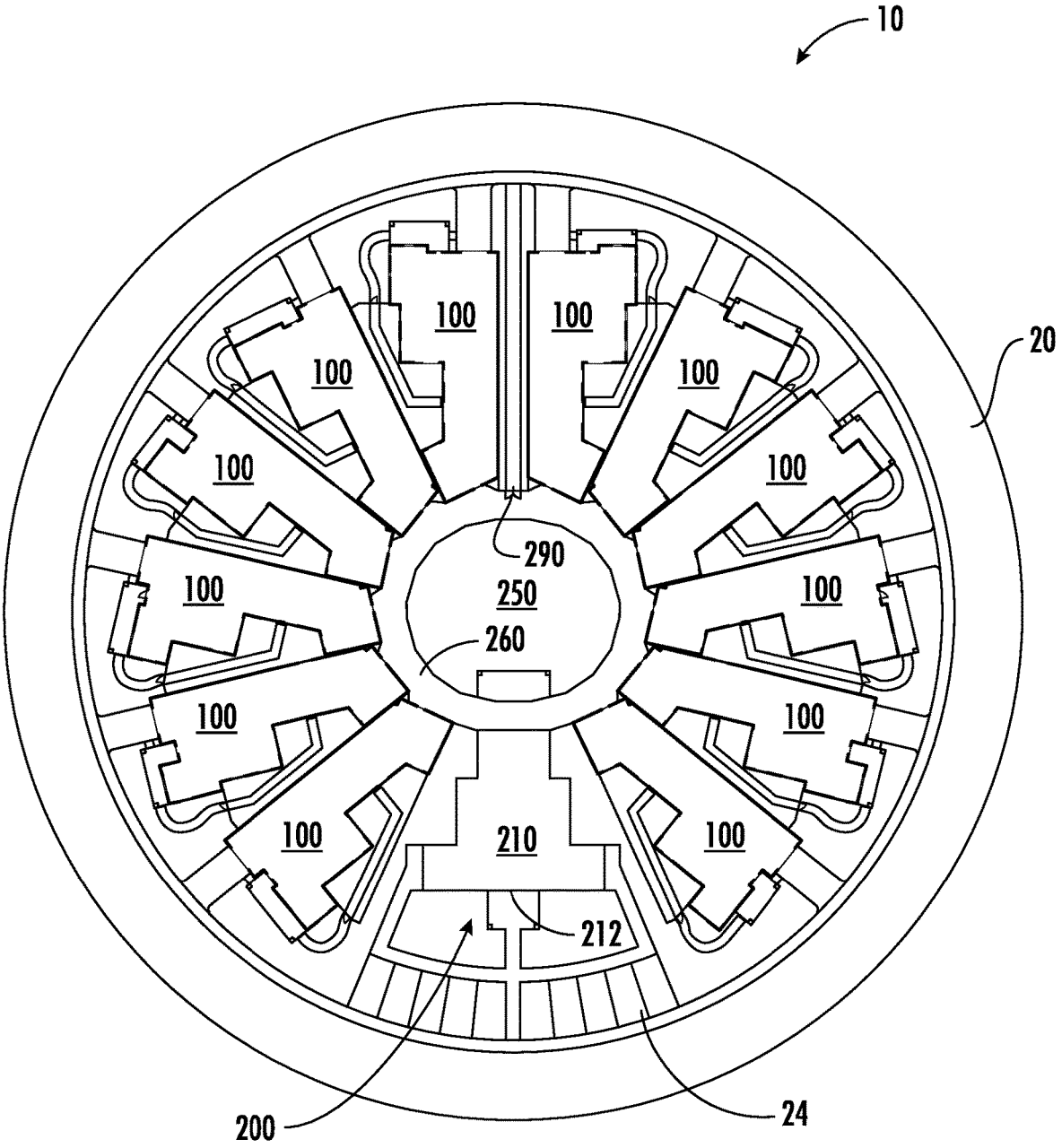
FIG. 1 is a plan view of a long-term care facility provided in accordance with the present disclosure.

The present disclosure will now be described more fully hereinafter with reference to example embodiments thereof with reference to the drawings in which like reference numerals designate identical or corresponding elements in each of the several views. These example embodiments are described so that this disclosure will be thorough and complete, and will fully convey the scope of the disclosure to those skilled in the art. Features from one embodiment or aspect can be combined with features from any other embodiment or aspect in any appropriate combination. For example, any individual or collective features of method aspects or embodiments can be applied to apparatus, product, or component aspects or embodiments and vice versa. The disclosure may be embodied in many different forms and should not be construed as limited to the embodiments set forth herein; rather, these embodiments are provided so that this disclosure will satisfy applicable legal requirements. As used in the specification and the appended claims, the singular forms "a," "an," "the," and the like include plural referents unless the context clearly dictates otherwise. In addition, while reference may be made herein to quantitative measures, values, geometric relationships or the like, unless otherwise stated, any one or more if not all of these may be absolute or approximate to account for acceptable variations that may occur, such as those due to manufacturing or engineering tolerances or the like.

As used herein, the term "staff" refers to a doctor, a nurse, or any other care provider and may include support personnel of a care facility. Throughout this description, the term "patient" refers to a resident or person who is under the care of the staff of the long-term care facility and may require round-the-clock or near round-the-clock care and the term "partner" refers to a spouse, relative, or other caregiver for the patient that is not a part of the staff. The partner may be a healthy partner who does not require any medial assistance or care or the partner may require some medical assistance from the long-term care facility.

Referring now to FIG. 1, a long-term care facility 10 is provided in accordance with the present disclosure. The long-term care facility 10 includes a plurality of residences 100 and common areas 200. The facility 10 may include a road or street 20 that surrounds the residences 100. The street 20 may be a public or private way that connects to infrastructure of a community adjacent the facility 10. The common areas 200 may include a central building 210, a courtyard 250, and a connecting hall or ring 260. The central building 210 may include an entrance 212 for the facility 10 that provides access to the facility 10 from outside the facility 10. The entrance 212 may allow for ingress and egress of staff and materials for the facility 10. In some embodiments, the facility 10 may include a second access 290 that accesses the connecting ring 260. The second access 290 may allow staff to ingress and egress the facility 10. In certain embodiments, the second access 290 may be a service entrance. In particular embodiments, the second access 290 may only be an emergency exit of the facility 10. The facility 10 may include a parking lot 24 for staff and/or visitors that is accessible from the street 20.

The central building 210 may act as a club house or common area to allow patients and partners to interact with staff or other patients and partners. The central building 210 is connected to the residences 100 by the connecting ring 260. The central building 210 may include offices, auditoriums, theaters, media rooms, kitchens, kitchenettes, seating areas, gaming rooms, art rooms, public or private conference rooms, or other types of common areas needed in a long-term care facility. The central building 210 may provide access to a courtyard 250.

The connecting ring 260 may be a passage or hallway that provides access to the residences 100 and the central building 210. In some embodiments, the connecting ring 260 may include seating areas or other common areas for patients, partners, and staff. The connecting ring 260 may provide access to the courtyard 250. In some embodiments, the courtyard 250 is only accessible from the central building 210. The courtyard 250 may include enrichment for the patients and/or partners. For example, the courtyard 250 may include a garden, plants, fountains, gazebo, or other enrichments. The courtyard 250 may be open to the sky, screened, or covered. In some embodiments, the courtyard 250 may have a retractable or temporary cover. The connecting ring 260 may include windows or other transparent or translucent walls that allow viewing of the courtyard 250 from within the connecting ring 260. As shown, the connecting ring 260 is circular in shape; however, in some embodiments, the connecting ring 260 may have straight walls that define a substantially polygonal shape about the courtyard 250. For example, the connecting ring 260 may be hexagonal, octagonal, decagonal, dodecagonal, tetradecagonal, hexadecagonal, or have more than 16 straight walls or sides. It will be appreciated that some of the straight walls defining the courtyard 250 may have a length longer or shorter than other walls. In some embodiments, a portion of the central building 210 may protrude into the courtyard 250.

Figure 2:
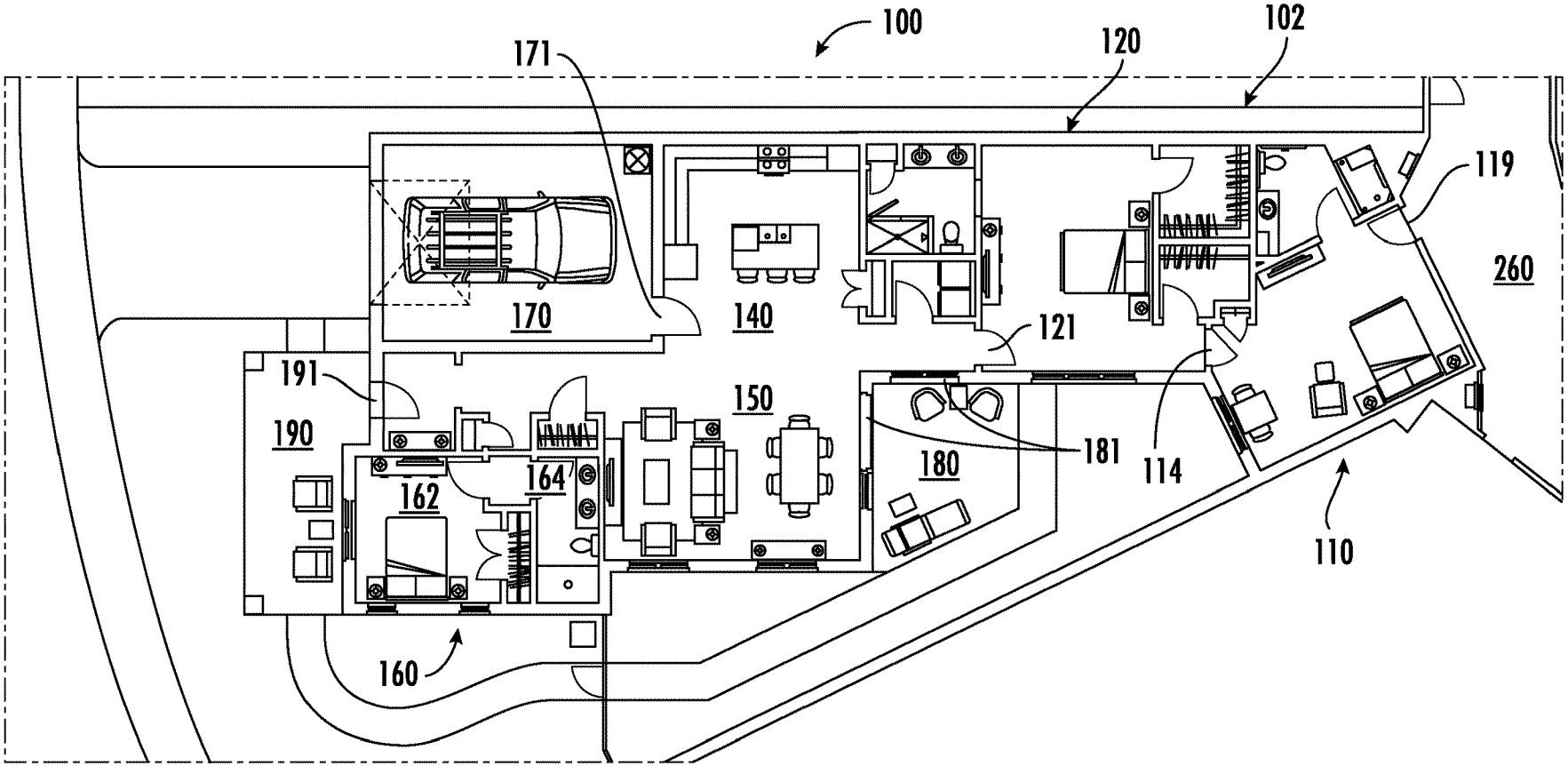
FIG. 2 is an enlarged plan view of a residence of the long-term care facility of FIG. 1.

With reference to FIGS. 1 and 2, each of the residences 100 are connected to the connecting ring 260. As shown, the facility 10 includes twelve residences 100 that are radially disposed about the connecting ring 260. In embodiments, a facility 10 may have between six and twenty-four residences 100 in a single level depending on the size of the residences, the connecting ring 260, and the facility 10 as a whole. As shown, each of the residences 100 is a standalone residence 100 except for a portion or room that connects to the connecting ring 260 as detailed below. In some embodiments, a single wall may be common to adjacent residences 100.

Each of the residences 100 includes a plurality of rooms which may include, but not be limited to, a care suite 102, a utility or laundry room 130 (FIG. 3), a kitchen 140, a living or great room 150, a guest suite 160, a garage 170, a patio 180, and a porch 190. The residences 100 may be modeled or styled to feel as a traditional standalone home or townhouse from the front of the home to a private bedroom entrance 121 to the care suite 102. As such, the rooms of the residences 100 may have a variety of uses or layouts depending on the residence, the partner, or the facility as a whole. For example, the guest suite 160 may include a guest bedroom 162 and a guest bathroom 164. However, in some embodiments, the guest bathroom 164 may be open to the hallway or the great room separate from the guest bedroom 162. Further, in certain embodiments, the guest bedroom 162 may be an office or other type of space. The rooms from the entrance to the start of the private bedroom entrance 121 of the care suite 102 may be configured to allow the partner to live as if they would outside of the facility 10 while residing in the same home as the patient.

The residence 100 includes an exterior entrance that may be a front door 191, a patio entrance 181, and/or a garage entrance 171 that provides access to the residence 100 from an exterior of the residence 100. The exterior entrance is separate from any entrances to the care facility for the central building 210 or the connecting ring 260. The exterior entrance allows the partner to freely enter and exit the residence 100.

Figure 3:
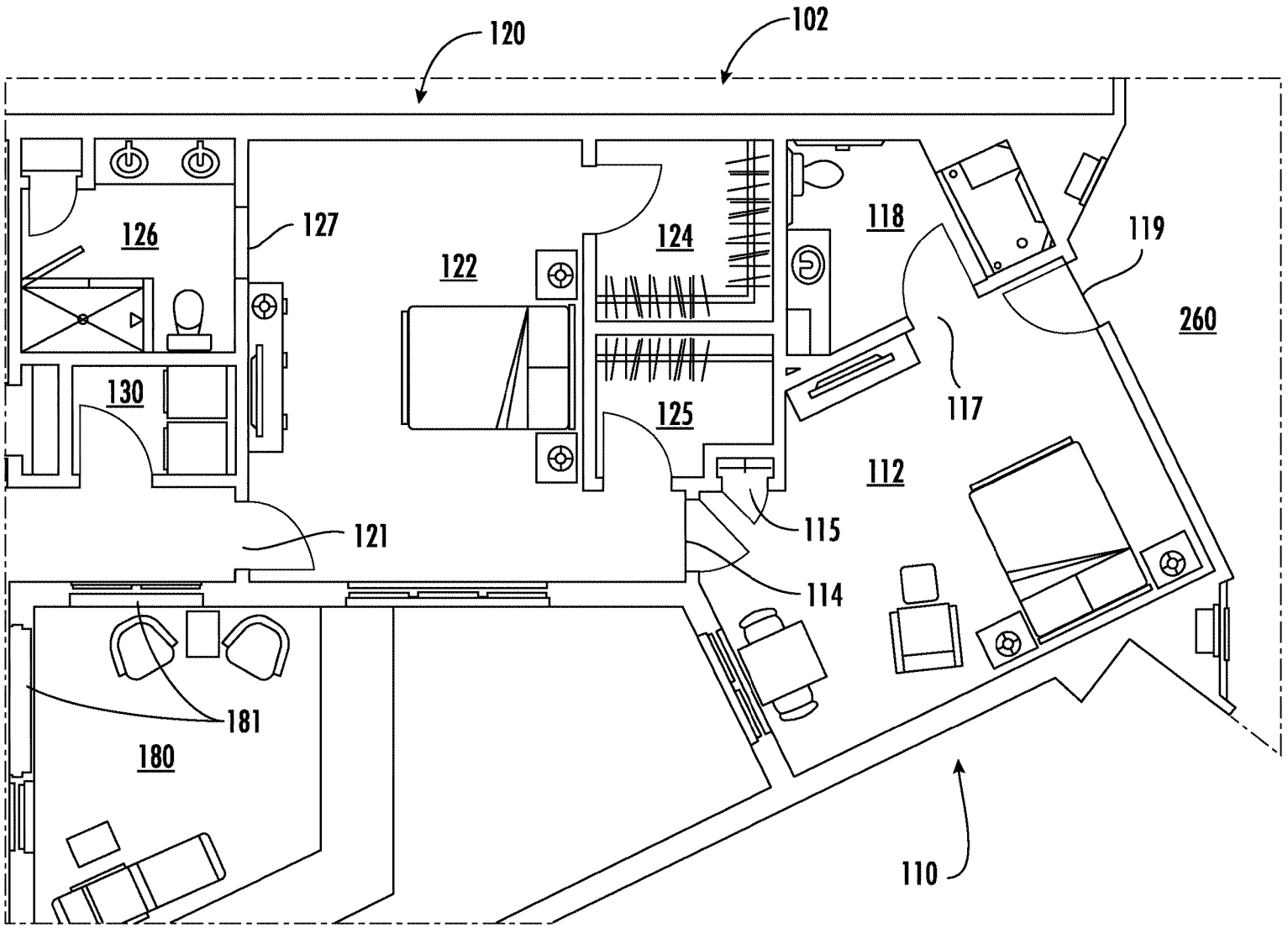
FIG. 3 is an enlarged plan view of a suite of the residence of FIG. 2.

With additional reference to FIG. 3, the care suite 102 includes a shared area 110 and a private area 120. Starting with the private area 120, the private area 120 includes the private bedroom entrance 121 that extends into the rest of the residence 100 and includes a private bedroom 122 and a private bathroom 126. The private area 120 may include dual closets 124, 125. The private area 120 may include an exit to a yard or a patio 180 that is directly into the private bedroom 122. The private bedroom 122 and the private bathroom 126 may be similar to a bedroom and bathroom found outside of a care facility. In some embodiments, the private bedroom 122 and/or the private bathroom 126 may have accessibility features to accommodate the partner or the patient. As detailed below, the private bedroom entrance 121 provides access to the private bedroom 122 from the exterior of the care facility 10 separate from other residences 100.

The shared area 110 includes a care bedroom 112 and a care bathroom 118. The care bedroom 112 accesses the remainder of the residence 100 through a residence entrance 114 that is disposed between the private area 120 and the shared area 110. The residence entrance 114 may be a secure entrance that allows the partner to control access into the rest of the residence from the shared area 110. For example, the partner may secure the residence entrance 114 to prevent staff or the patient from entering the rest of the residence 100 through the residence entrance 114 when the partner is not home, is asleep, or just needs a respite. This may be for safety or the privacy of the partner. Securing the residence entrance 114 may allow for the partner to separate from the patient or the rest of the facility 10 when needed or desired. The care bedroom 112 also includes a care entrance 119 that is disposed between the care bedroom 112 and the connecting ring 260. The care entrance 119 may be secured such that staff is capable of freely entering and exiting the care bedroom 112 from the connecting ring 260. The care entrance 119 may allow the patient or the partner to enter the connecting ring 260 from the residence 100.

The care bedroom 112 is configured to meet the needs of the patient and to allow the staff to care for the patient within the care bedroom 112. The care bathroom 118 may be configured to meet the toileting and/or hygiene needs of the patient with or without the assistance of the staff or the partner. The shared area 110 may include a care closet 115 that is sized to accommodate a limited number of changes of clothes for the patient. For example, the care closet 115 may be sized to fit only one day of clothes for the patient. In some instances, the partner may place the clothes in the care closet 115 from one of the closets 124, 125 from the private area 120 for the patient. The shared area 110 may be configured to provide care for the patient. For example, the shared area 110 may be configured to provide care for a dementia patient.

In use, the residence 100 may allow the patient and the partner to spend more time together than what would be available if the patient were in a traditional care facility. For example, in a traditional care facility, the partner is able to visit during limited hours and may not be able to share meals privately or other aspects of life with the patient. With some patients, e.g., memory care patients, being around their partner may improve the emotional state of the patient. Being separated may cause undue stress on the patient and/or the partner. In addition, the idea of being separated may prevent or dissuade a partner or a patient from getting the care needed. In the residence 100, the patient may eat at the table with the partner in the residence, e.g., in the kitchen 140 or the great room 150. In the residence 100, the patient may sit in a recliner or other seat with the partner before returning to the shared area 110 at the end of the day or when additional support from the staff is needed. As such, the residence 100 may allow a couple to live together while having access to the staff when needed. Further the shared area 110 may be configured to enrich the life of the patient based on the needs of the patient. For example, the shared area 110 may include features of an assisted living memory care bedroom.

Referring back to FIG. 1, the configuration of the residences 100 with the connecting ring 260 may place the shared areas 110 of the residences 100 (FIG. 2) within a predetermined distance from the central building 210. Placing each of the shared areas 110 within a predetermined distance from the central building 210 may allow for quick response from the central building 210 to a shared area 110 in the case of an emergency. For example, when the courtyard 250 within the connecting ring 260 has a diameter of 70 feet, the shared areas 110 of the residences farthest away from the central building 210 may be 135 feet or less. In some embodiments where the connecting ring 260 has a large diameter, e.g., to accommodate more residences, or when a quicker response is needed, the facility 10 may include additional features to lower response times. For example, the facility 10 may include one or more staff stations within the connecting ring 260. In some embodiments, the facility 10 may include another central building opposite the central building 210. In some embodiments, the central building 210 may include patient rooms separate from the residencies that may be used to care for additional patients.

While several embodiments of the disclosure have been shown in the drawings, it is not intended that the disclosure be limited thereto, as it is intended that the disclosure be as broad in scope as the art will allow and that the specification be read likewise. Any combination of the above embodiments is also envisioned and is within the scope of the appended claims. Therefore, the above description should not be construed as limiting, but merely as exemplifications of particular embodiments. Those skilled in the art will envision other modifications within the scope of the claims appended hereto.

What is claimed:

1. A care facility comprising:

a connecting ring;

a central building disposed outside of and connected to the connecting ring; and a plurality of residences disposed about the connecting ring, each residence of the plurality of residences comprising:

a shared area having a care bedroom connected to the connecting ring, the care bedroom accessible directly from the connecting ring, the care bedroom having a care closet directly accessible from the care bedroom;

a private area including a private bedroom connected to the care bedroom and separated from the connecting ring, the private bedroom having a private closet directly accessible from the private bedroom, the care bedroom accessible directly from the private bedroom through a residence entrance, the residence entrance being securable to prevent access from the care bedroom and the connecting ring; and an exterior entrance that provides access to the private bedroom separate from the connecting ring and the central building.

2. The care facility according to claim 1, further comprising a plurality of rooms, the plurality of rooms accessible from the exterior entrance or the private bedroom entrance.

3. The care facility according to claim 2, wherein the plurality of rooms includes a kitchen.

4. The care facility according to claim 1, wherein the shared area includes a care bathroom accessible from the care bedroom and the private area includes a private bathroom accessible from the private bedroom.

5. The care facility according to claim 1, wherein the care closet is sized to hold only a single day worth of clothing.

6. The care facility according to claim 1, further comprising a courtyard, the connecting ring disposed about the courtyard such that the courtyard is disposed within a space defined by the connecting ring.

7. The care facility according to claim 6, wherein the connecting ring defines a substantially circular shape for the courtyard.

8. The care facility according to claim 6, wherein the courtyard is only accessible from the central building.

9. The care facility according to claim 1, wherein the central building defines a main entrance that provides access to the central building, the connecting ring, and the shared areas via the connecting ring.

10. The care facility according to claim 1, wherein the connecting ring includes a service entrance that provides direct access to the connecting ring, the service entrance on an opposite side of the connecting ring from the central building.

11. The care facility according to claim 1, wherein the shared area includes a care entrance between the care bedroom and the connecting ring, the care entrance securable from the care bedroom to limit access to the care bedroom from the connecting ring.

12. The care facility according to claim 11, wherein the care entrance is securable from the connecting ring to limit access to the connecting ring from the care bedroom.

13. The care facility according to claim 1, wherein the care bedroom is configured to care for a memory care patient.

14. The care facility according to claim 1, wherein the plurality of residences includes 12 residences disposed about the connecting ring.

15. A care facility comprising:

common areas; and a plurality of residences, each residence of the plurality of residences comprising:

a shared area having a care bedroom connected to the common areas such that the shared area is accessible from the common areas, the care bedroom having a care closet directly accessible from the care bedroom;

a private area including a private bedroom connected to the care bedroom and separated from the common areas by the care bedroom, the private bedroom having a private closet directly accessible from the private bedroom, the care bedroom accessible directly from the private bedroom through a residence entrance, the residence entrance being securable to prevent access from the care bedroom and the common areas; and an exterior entrance that provides access to the private bedroom separate from the common areas.

16. The care facility according to claim 15, wherein the common areas include a connecting hall, each care bedroom accessible directly from the connecting hall.

17. The care facility according to claim 16, wherein the common areas include a central building, the central building providing access to the exterior of the care facility and to the connecting hall.

18. A private residence comprising:

a care suite comprising:

a shared area having a care bedroom and a care bathroom, the care bedroom having a care entrance configured to connect to a common area of a care facility to allow access to the care bedroom separate from the rest of the private residence, the care bathroom directly accessible from the care bedroom; and a private area including a private bedroom, the private bedroom having a residence entrance defined between the care bedroom and the private bedroom to allow allowing access directly to the care bedroom from the private bedroom, the private bedroom having a bedroom entrance separate from the residence entrance, the private bedroom having a private closet directly accessible from the private bedroom; and an exterior entrance that is connected to the residence entrance allowing access to the private bedroom from an exterior of the private residence without passing through the shared area of the care suite.

19. The private residence according to claim 18, further comprising a plurality of rooms between the exterior entrance and the bedroom entrance.

20. The care facility according to claim 1, wherein the connecting ring includes a service entrance that provides direct access to the connecting ring, the service entrance on an opposite side of the connecting ring from the central building.

* * * * *